United States Patent [19]

Goushaw

[11] 4,274,263

[45] Jun. 23, 1981

[54] CONTINUOUSLY REFRIGERATED, AUTOMATICALLY EJECTED BLOCK ICE MACHINE

[76] Inventor: David W. Goushaw, R.R. 1, Box 814, Sahuarita, Ariz. 85629

[21] Appl. No.: 120,551

[22] Filed: Feb. 11, 1980

Related U.S. Application Data

[62] Division of Ser. No. 899,533, Apr. 24, 1978, Pat. No. 4,205,534.

[51] Int. Cl.[3] ..... F25C 5/02

[52] U.S. Cl. ..... 62/71; 62/177

[58] Field of Search ..... 62/71, 177, 347, 353

[56] References Cited

U.S. PATENT DOCUMENTS

| | | | |
|---|---|---|---|
| 2,971,346 | 2/1961 | Frei | 62/71 |
| 3,074,248 | 1/1963 | Bauerlein | 62/353 X |
| 3,287,927 | 11/1966 | Jacobus | 62/353 X |
| 3,306,072 | 2/1967 | Dahlgren et al. | 62/353 X |
| 3,367,127 | 2/1968 | Walker | 62/353 X |
| 3,388,560 | 6/1968 | Moreland | 62/353 |
| 4,099,946 | 7/1978 | Alexander | 62/73 |

*Primary Examiner*—William E. Tapolcai, Jr.

*Attorney, Agent, or Firm*—J. Michael McClanahan

[57] ABSTRACT

A continuously refrigerated, automatically ejected block ice machine having means to measure and supply a specified amount of water to a water distributor which appropriately directs each measured amount of water to each of a plurality of product cells in which the ice is formed, the product cells, being an integral part of the evaporator of a refrigeration system. The water which is permitted to enter the bottom of the product cell forcing up the frozen block of ice where it is harvested. Upon the completion of the water entering the product cell, means are provided to remove water proximate the cell to prevent freezing. The operation is automated through each of the product cells, each cell filled with new water and ejecting the frozen ice block, the new water permitted to be frozen and the operation repeated.

4 Claims, 10 Drawing Figures

CONTINUOUSLY REFRIGERATED, AUTOMATICALLY EJECTED BLOCK ICE MACHINE

This is a division of application Ser. No. 899,533, filed Apr. 24, 1978 now U.S. Pat. No. 4,205,534.

BACKGROUND OF THE INVENTION

Heretofore, the production of block ice in commercial quantities has been a labor intensive process and a very inefficient energy wise process. The custom has been to freeze water in cells which are immersed or partially immersed in a cold brine solution which does not freeze at the freezing temperature of ice. Thereafter it has been necessary, after the water in the ice product cells has frozen, to heat by some means the outside of the product cell to melt the ice immediately next to the interior walls of the product cell in order that the ice may be removed. Then, the ice, once removed is placed into refrigerator storage where the immediate outside of the ice block must be re-frozen.

As is obvious, this provides for an immensely inefficient and energy wasting system, first from the aspect that an intermediary, i.e., the brine solution must be cooled in order to cool the ice product cell to freeze the water inside; and second that the product cell walls must be heated to release the ice contained therein.

In addition, it is obvious that great expenditure of labor is necessary to fill the ice product cells with initial water and then, upon the freezing of the block ice, to remove the ice. In the present situation, because of the inefficiency and slowness of removing heat from the ice product cell's water to the brine solution and then the refrigeration system evaporator, the freezing of water takes approximately eight hours per cycle. This, it is obvious, ties up a great deal of capital in machinery for what turns out to be a small amount of ice harvested in relation to the capital expended.

Accordingly, there is a need for a block ice making machine which operates as efficiently as possible, as rapidly as possible, and in which as many as the operations as possible may be done automatically, especially the filling of the product cells with new water and the removal of the newly formed ice block.

SUMMARY OF THE INVENTION

The present invention comprises apparatus and system where means are provided for the automatic manufacture of blocks of ice requiring only an operator to start the system with each new cycle of ice to be formed and to gather up the resultant block ice which has been placed in an advantageous position to be gathered.

More specifically, means are provided for injecting a pre-determined amount of water into product ice cells and while doing so, to eject the formed ice from the product cell. In the present invention, water is supplied to a counting type water meter which measures a predetermined quantity of water and directs the water to a water distributor mechanism. The distributor mechanism receives the water from the water meter and in turn, directs it to each of a series of product cells. The water meter emits a signal each time a certain amount of water has passed, which signal in turn indexes the water distributor from one ice product cell to the next. The water, at the appropriate time, enters sequentially each product ice cell through the means of a bleedback valve which directs, when supplied with pressurized water, the water into the base of the product cell past a flat flapper valve, the water pressure pushing upon the bottom of the ice formed in the cell and, through slightly tapered outward cell walls, pushes the block ice up to the top of the cell where the ice is gathered.

Upon the completion of a pre-determined amount of water flowing into the product cell, the flapper valve is sealed, held in place by the water pressure above. The pressure being relieved in the water line feeding the product cell by the advancement of the water distributor, permits the bleedback valve to discharge the water immediately adjacent to the product cell in order that no ice should form in the water supplying lines. This sequence is repeated sequentially for each product cell until all the plurality of product cells have been filled with new water and thereby ejected the formed ice. The product cell comprises a part of the evaporator connected to the refrigeration system and, the walls of the product cell being of metal, permits the passage of heat from the water interior to the product cell into the expanding refrigerant gases surrounding the product cell, the freezing of the water therein being done most expeditiously. After the water has frozen in the product cell, nominally a period of approximately two hours, the sequence is repeated by depressing a start switch, and the ice is harvested.

Accordingly, it is an object of the present invention to provide apparatus whereby block ice may be formed in a very rapid and expeditious manner.

It is further an object of the present invention to provide apparatus whereby a plurality of ice product cells are filled automatically with new water to be frozen.

It is still further an object of the present invention to provide means whereby new water entering the product cell automatically ejects the ice formed from the prior admitted water.

It is still further an object of the present invention where block ice is continuously and automatically produced by means which automatically measures and directs a pre-determined amount of water into an ice product cell, and by doing so, eject the ice product for harvesting, and to remove water not interiorly to the product cell, but adjacent thereto, automatically.

DETAILED DESCRIPTION OF PREFERRED EMBODIMENT

Figure 1:
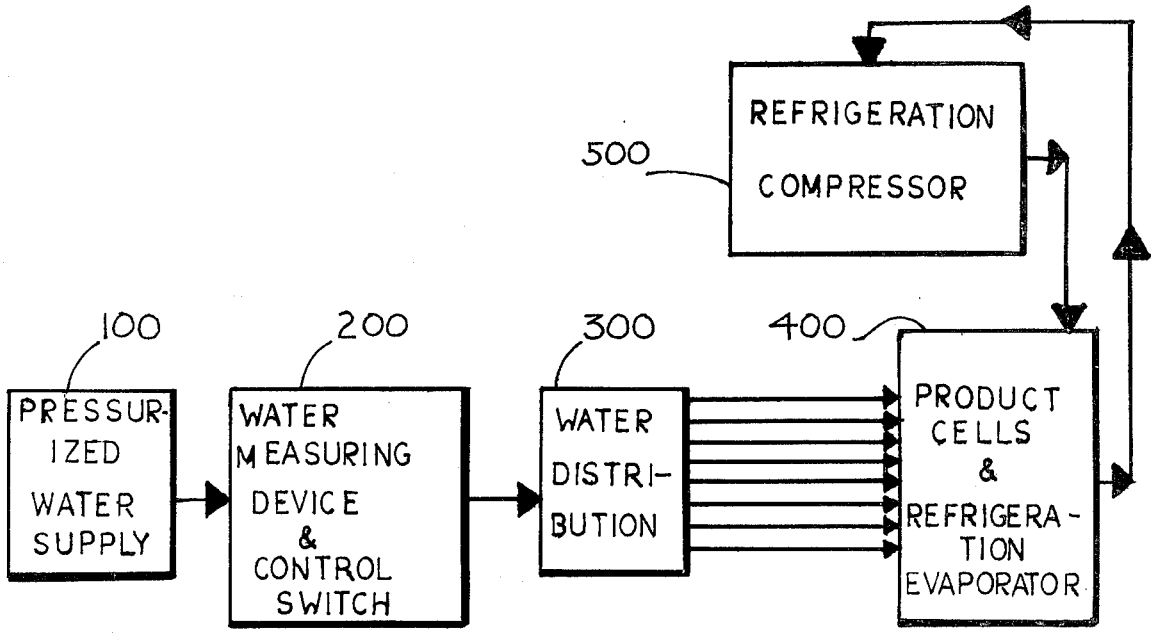
FIG. 1 is a functional block diagram of the subject invention.

Reference now to FIG. 1 shows a functional block diagram of the preferred embodiment of the invention, a continuously refrigerated automatically ejected block ice machine. Proceeding from left to right, functional block 100 represents a source of pressurized water supply, such as the water system which is found in cities and towns. It has been determined that in most cases, normal city water pressure is sufficient for operation of the invention. Connected to and receiving water from the pressurized water supply, functional block 100, is water measuring device and control switch functional block unit 200 which in turn measures amounts of water passed under pressure to water distributor functional block 300, informing the water distributor when the measured amount of water passes. The water distributor directs the water along an appropriate water lines connecting to certain ice freezing cell, appropriately termed product cell, contained within water freezing cell and refrigerator evaporator functional block 400. Additionally connected to functional block 400 is refrigeration compressor system functional block 500 which is connected in a standard refrigeration type configuration utilizing the water freezing product cells as the evaporator in the refrigeration system.

In the functional block diagram shown in FIG. 1, water is brought in from the local water supply under local water pressure or with added pressure if required, measured and controllably distributed to the water distributor. The water distributor water distribution lines connect directly to the bottom portion of water freezing product cells in functional block 400 which, at the appropriate time, is sequentially injected into each individual cell where the water pressure forces newly formed ice from the product cell where the ice may be harvested. Thereafter, the water which was used to remove the ice is then frozen to become the next block. The outside circumferencial surface of the product cell comprises a portion of the refrigeration system evaporator where the refrigerant gas is evaporated and thus removes the heat from the product cells permitting the water to change to ice.

In the usual configuration, the water distributor will sequentially direct water to each of the product cells until all formed ice has been forced out of the cells for harvesting. The system then lies quiesent while the refrigeration system operates freezing the new water in the product cells. After all the cells are frozen, the operation is repeated, sequentially ejecting each frozen block of ice with new water which becomes the next block of ice.

Figure 2:
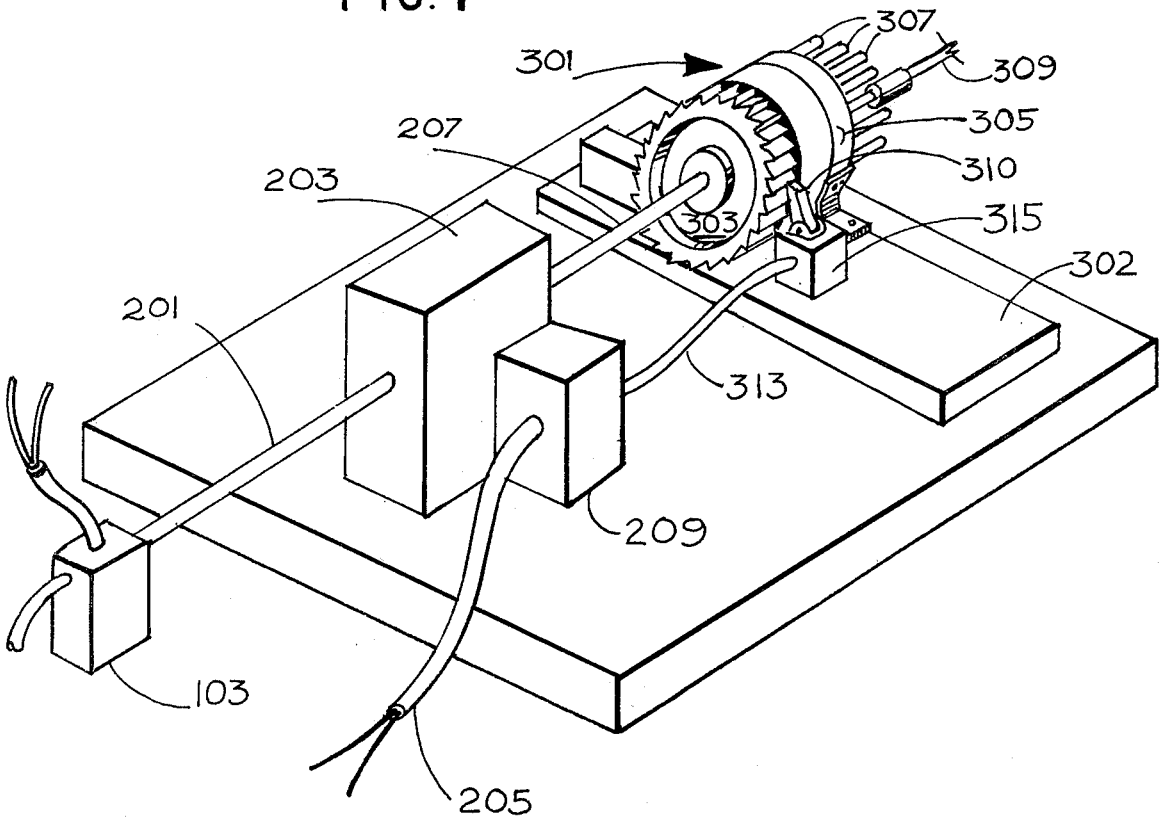
FIG. 2 is a perspective view of the water meter and water distributor portion of the invention.

Referring now to FIG. 2, a perspective view of the invention referred to in functional blocks 200 and 300 is detailed. More specifically, water inlet line 201 receives water from the pressurized water supply (functional block 100 of FIG. 1) after the water passes solenoid operated main water supply valve 103 where the water is directed to the commercially available water meter 203. Water meter 203, upon the passage of a measured amount of water therethrough, mechanically indicates to a switch contained in meter control switch housing 209 of the passage of the water, which switch in turn signals such event to water distributor index assembly box 315. Switch S2 (FIG. 9) is contained interiorly to meter control switch housing 209, is actuated by a cogged wheel rotated by water passing through water meter 203.

Figure 3:
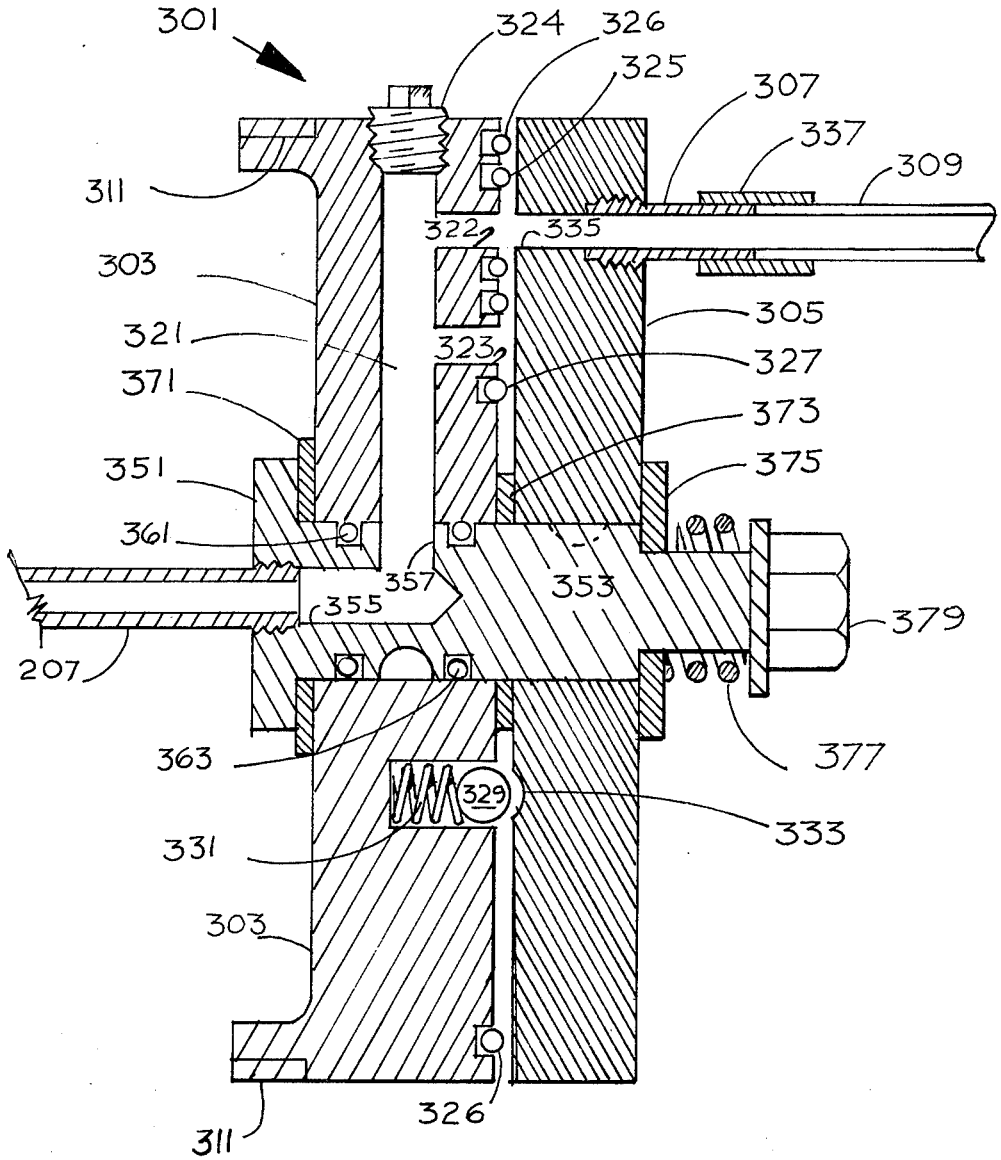
FIG. 3 is a cutaway side view of the water distributor.
Figure 4:
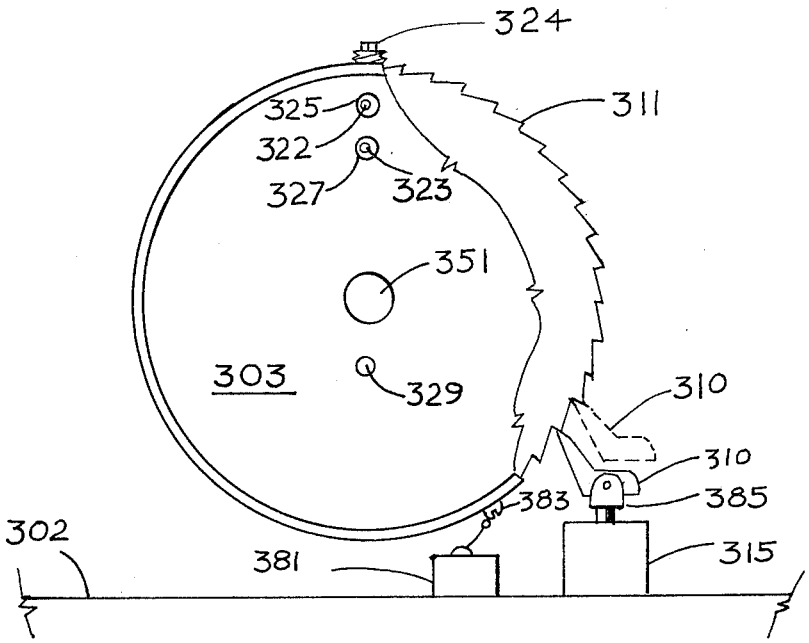
FIG. 4 is a rear view of the driven index member of the water distributor.
Figure 6:
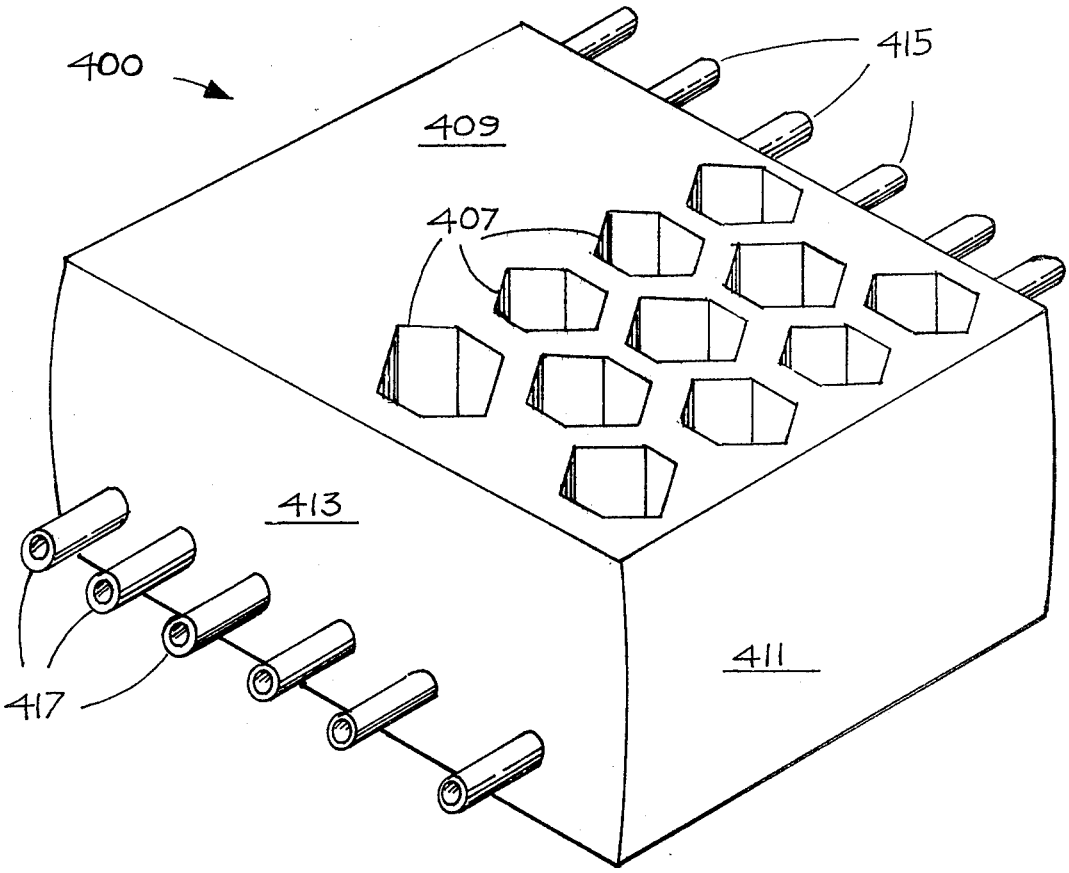
FIG. 6 is a perspective view of the product cell and refrigeration evaporator.
Figure 9:
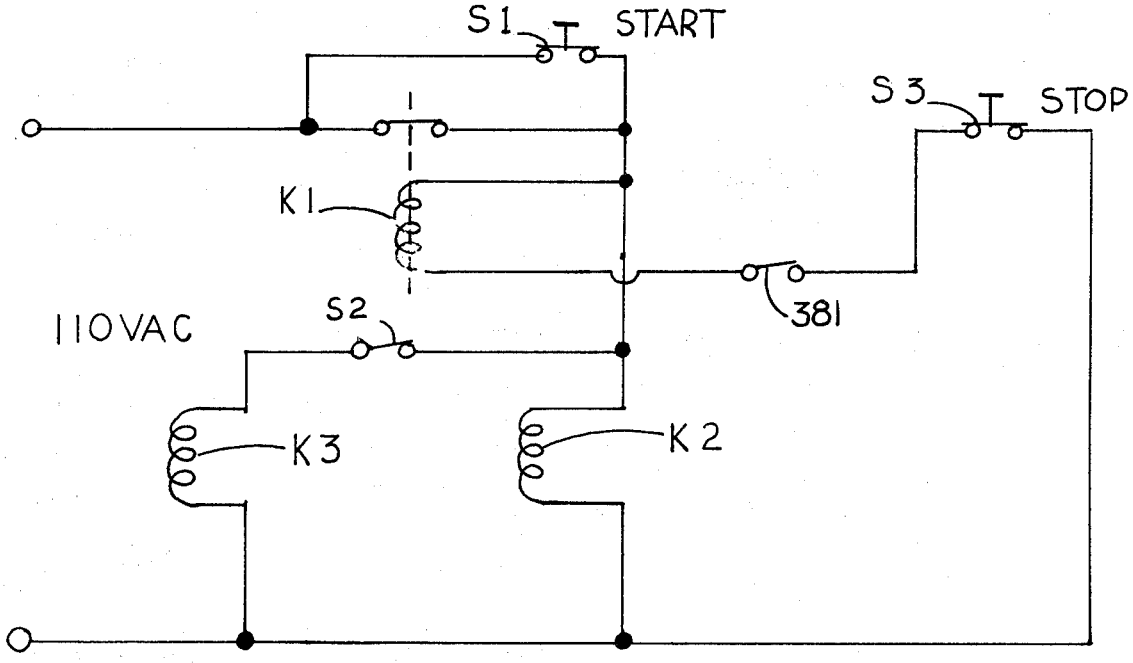
FIG. 9 is an electrical schematic of the electrical portion of the invention.

Water distributor 301, which is represented in FIG. 1 by functional block 300, has as its purpose the distribution of the measured amount of water received from water meter 203 to the appropriate water freezing ice cell, or product cell in functional block 400 (FIG. 1). More specifically, water distributor 301 comprises a rotating driven index member 303 which slides past stationary index member 305 to align with a plurality of orifices therethrough. Nominally, there are 32 such orifices in the preferred embodiment of the invention. The orifices penetrate the flat sides of stationary index member 305 are aligned with water passageways internal to driven index member 303 in order that water supplied water distributor 301 is appropriately directed to the desired product cell. Shown emanating from the back portion of water distributor 301 are a portion of the plurality of distributor water outlets 307, each of which connects with and encompasses one of the aforementioned orifices. Shown for illustrative purposes is product cell water line 309 which connects the distributor water outlet 307 to an appropriate product cell, some of which are shown in FIG. 6. Formed in the outside periphery of driven index member 303 are index slots 311 by means of which solenoid operated index pawl 310, upon appropriately received signal from water meter 203 control switch S2 contained in meter control switch housing 209, via control system electrical line 313 rotates driven index member 303. Index pawl 310 engages the index slots on the periphery of driven index member 303 and drives the member around 1/32 of a revolution on each solenoid operation. An exploded view of water distributor 301 is shown in FIGS. 3 and 4. An electrical schematic of the control system is shown in FIG. 9 and an explanation of the control sequence is described infra.

Referring now to FIG. 3, a cross sectional view taken through the side center section of water distributor 301 is outlined. Proceeding from left to right, circular plate like driven index member 303 with index slots 311 at its periphery is shown. Proceeding from the top through driven index member 303 is water passageway 321 which is drilled into member 303 and more particularly described as follows. The main portion of water passageway 321 comprises an elongated hole drilled from the outer periphery of member 303 to its central hub opening. This passageway is externally capped by end plug 324 which is shown threaded in place at the periphery. Penetrating the interior flat circular side of driven index member 303 to the main water passageway 321 are two water passageways 322 and 323. It is noted that interposed between driven index member 303 and stationary index member 305 are a plurality of O-ring seals 325 and 327 which encompass in water sealing fashion between driven index member 303 and stationary index member 305, passageway 322 and 323 respectively. Near the outer periphery of driven index member 303 is located O-ring 326 which seals all internal portions between driven index member 303 and stationary index member 305. A continuation of O-ring 326 is shown in the bottom portion of the figure also.

In the bottom half of driven index member 303 is shown the mechanism for alternately aligning passageways 322 and 323 with a corresponding orifice through stationary index member 305, namely detent ball 329 which is urged against stationary index member 305 by detent spring 331. The hole which houses detent spring 331 and detent ball 329 is drilled into the circular flat plate side of driven index member 303. Corresponding and appropriately placed diametrically opposite each orifice through stationary index member 305 is detent dimple 333 in stationary index member 305. Detent dimple 333 receives detent ball 329 as driven index member 303 is rotated by the solenoid driven index pawl assembly, which is illustrated in more detail in FIG. 4.

Continuing with the description of stationary index member 305, which comprises a circular plate like disc having the circular face opposite driven index member 303 circular face, one orifice of the 32 of the preferred embodiment is shown, namely the orifice formed by walls 335. A portion of orifice walls 335 are drilled and tapped in order to receive distributor water outlet 307 which in turn connects with product cell water line 309, a water seal between the two pieces maintained by sleeve 337. Shown in alignment position with water passageway 322 of driven index member 303 is the orifice 335 of stationary index member 305, which orifice does permit water passage from the water passageways of member 303. As mentioned earlier, product cell water line 309 goes to a specific product cell in the water freezing cell and refrigeration evaporator already broadly described as functional block 400 in FIG. 1.

As driven index member 303 is rotated one pass by the solenoid index assembly, the next sequential orifice (not shown) in stationary index member 305 is brought into alignment with water passageway 323 of driven index member 303. It is noted that the O-ring seals 325 and 327, which are set in annular slots concentric with passageways 322 and 323, compress against stationary index member 305 and seal to same to prevent the escape of water from the driven index member 303 water passageways.

Proceeding now to the central portion of FIG. 3, central hub 351 is shown which passes through the central opening found in both driven index member 303 and stationary index member 305. Hub 351 is stationary, as is stationary index member 305, and is held such by means of woodruff key 353 which nests in slots formed in stationary index member 305 and central hub 351. Central to hub 351 is the water passageway formed by walls 355, which passageway penetrates the central hub 351 just far enough to meet a second water passageway coming from the cylindrical periphery of central hub 351, said passageway formed by walls 357. Both passageways are drilled into central hub 351 when fabricating. At the outside end of the passageway formed by walls 355, the walls are tapped to receive water line 207. Noted in the central lower portion of central hub 351 is half-round water passageway formed by walls 359 which comprises an annular ring formed in hub 351 and which joins the water passageway formed by drilled walls 357. This annular passageway permits water from water line 207 to enter water passageway 321 of driven index member 303 regardless of the relative position of member 303. Sealing in water tight fashion are circular O-rings 361 and 363 which surround, in annular parallel configuration, the annular water passageway walls 359 formed in hub 351. The O-rings 361 and 363, which nest interior to an annular slot formed in hub 351, compress against all sides of the annular slot and the interior periphery of the central hole of driven index member 303 and present a water tight situation.

The remaining elements shown in FIG. 3 comprise the brass thrust washer 371 between hub 351 and driven index member 303; brass thrust washer 373 which nests interposed driven index member 303, stationary index member 305, and central hub 351; and finally tension washer 375 interposed between stationary index member 305, central hub 351, and tension spring 377. Tension spring 377 in turn places tension on the combination of driven index member 303 and stationary index member 305 by means of machine nut 379 which screws upon threads (not shown) cut in central hub 351.

Reference now is made to FIG. 4, a view of the back face of driven index member 303 where a portion has been removed to illustrate the index teeth 311 which are on the peripheral circumference of driven index member 303, which teeth are engaged by the index pawl 310. Shown central to driven index member 303 is the shaft of central hub 351 together with detent ball 329. Above central hub shaft 351 are the two sealing O-rings 325 and 327 which surround and encompass water outlet passageways 322 and 323. Located adjacent to the periphery of driven index member 303 is O-ring 326 which seals driven index member 303 flat face to the flat front face of the stationary index member 305. To the immediate top of driven index member 303 is water passageway end plug 324.

Shown on the bottom of the figure is base plate 302 upon which rests water distributor 301. Directly below driven index member 303 is index micro switch 381, sometimes termed cycle limit switch, which, as will be explained later, indicates when the driven index member 303 has made one complete revolution thereby completing one cycle of supplying water to each of the ice product cells. Index micro switch 381 has a little roller on its leaf contact which rides on the round smooth peripherial surface bordering the peripherial index teeth 311. At one point on the periphery, a rounded screw head 383 protrudes from the outer periphery, this screw head attaches to a screw body which screws into a tapped hole in the driven index member 303. Index micro switch 381 rides up upon the screw head 383 and indicates one complete cycling of the water distributor. To the immediate right of index micro switch 381 is the index assembly box 315 which has internally to it index pawl 310 assembly. Index pawl 310 assembly comprises a solenoid 385 which, when activated, rides up out of index assembly box 315, and engages index teeth 311, rotating the driven index member 303 by 1/32 revolution, or by whatever number of product cells the system is designed to include in one cycle. Shown in solid lines in FIG. 4 is index pawl 310 in position to raise and thus perform one revolution of the driven index member 303. Shown in dotted form is index pawl 310 in engaged position where it has risen to the top of its travel and thereby taken the tooth being engaged up by 1/32 of a revolution. Index pawl 310 rides in a slot cut in the top of solenoid 385 shaft whereby index pawl 310 is allowed a small amount of rotational freedom to adjust to the curvature of driven index member 303 as the solenoid rises straight up. When the solenoid returns to its relaxed or unengaged position at its lowest point, the end of index pawl 310 rides up over the long extending surface forming the upper portion of the index teeth 311, over the edge of the next lowest tooth and then resides in position such that it engages the bottom portion of the next lowest index tooth. The electrical schematic diagram showing the interconnection between index micro switch 381 (cycle limit switch) and the index assembly box 315 is shown in FIG. 9 infra.

Figure 5:
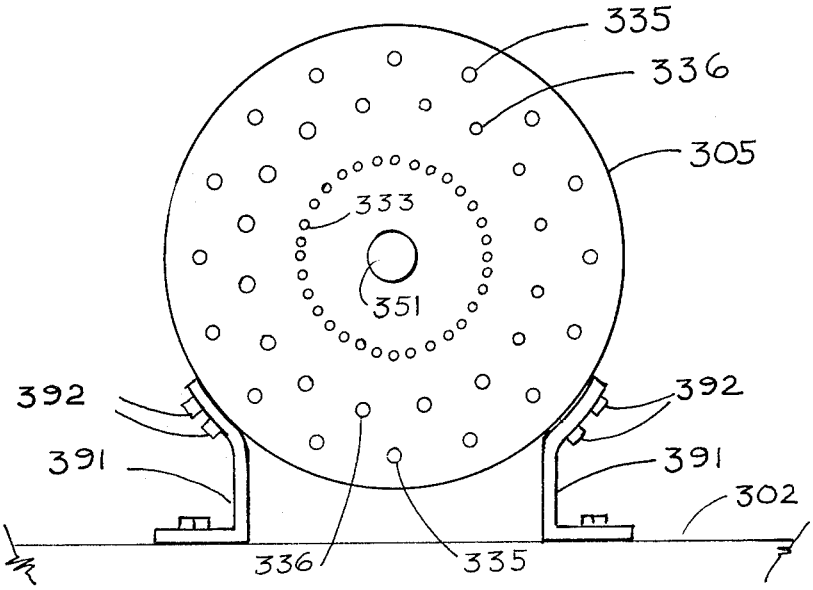
FIG. 5 is a front face view of the stationary index member of the water distributor.

Referring now to FIG. 5, a front view of the stationary index member 305 face over which the flat face of the driven member index 303 slides, is detailed. Shown interiorly is the shaft of central hub 351 which is immediately surrounded by 32 detent dimples 333 which alternately receive the detent ball 329 (FIGS. 3 and 4) for alignment purposes. This permits correct alignment of the water passageways 322 and 332 of the driven index member 303 with the orifices 335 and 336 respectively of stationary index member 305. The orifices 335 which penetrate the stationary index member 305 are aligned at a given radius from the center and in the preferred embodiment comprises 16 in number. Similarly orifices 336, which are interspersed equally between orifices 335, reside at a lesser radius from the stationary index member 305 center. It will be noted that for every orifice 335 and 336, there is in a radial line, a detent dimple 333. As mentioned earlier, orifices 335 sequentially align with the one water passageway 322 of driven index member 303 and orifices 336 sequentially align with the one water passageway 323 of driven index member 303, each orifice taking its turn as the driven index member 303 rotates. Attached to stationary index member 305 are support brackets 391 which attach by means of threaded bolts 392 which penetrate the support brackets into the stationary index member 305. All orifices and detent dimples shown in stationary index member 305 are equally spaced.

Reference now is made to FIG. 6 which represents the functional block 400, the water freezing product cells and refrigeration evaporator in which the product, the ice, is frozen. Specifically, a portion of the 32 product cells 407 are shown with the top rim of each cell attached by welding or other securing and sealing method to the top plate 409 of the refrigerator evaporator 400. Shown surrounding the product cells 407 are end 411 and side 413 of the evaporator. Protruding from the front side 413 are refrigerator refrigerant gas inlets 417 and from the opposite side, refrigerant gas outlets 415. In the preferred embodiment there are six outlets 415 and six inlets 417. Nominally, the gas inlets are on the bottom portion of the side 413 and the gas outlets are on the top portion of the opposite corresponding side. In the preferred embodiment, there are 32 product cells 407, each of which, in cross section, is hexagonal in shape and are dispersed such with each other as to occupy a minimum amount of area of top plate 409, much as shown in FIG. 6. The product cells 407 which are described in more detail in FIG. 7 run from top plate 409 to the corresponding bottom plate (not shown). In the preferred embodiment it has been found useful, because of the refrigerant gas pressure outside the product cells and inside refrigerator evaporator unit 400, to bow outward the side 413 and its corresponding back side, as well as end 411 and its corresponding opposite end. As the refrigerant gas interior to the refrigerator evaporator unit 400 is under pressure all seams are welded. This includes the junction of the top and bottom plates to the sides and to the ends as well as the relationship of the ends to the sides. Hexagonal shaped holes are cut in the top plate 409 as well as its opposite bottom plate and the cells are passed through these holes such that the top of each cell is flush or nearly flush with the top plate 409 and its counterpart bottom plate. Then the outside of the product cell 407 and the top plate 409 as well as the bottom plate are welded in place so that a pressure tight weld or seal is formed around each of the product cells at their opposite ends. In this manner, the total refrigerator evaporator unit 400 interior is sealed. The refrigerant gas which enters the refrigerator evaporator unit 400 through means of inlet 417 then may pass from its liquid to its vapor state in the interstices between the various product cells 407. It is suggested that as much of the refrigerator evaporator unit 400 be enclosed with insulation as possible. This would include the sides, the ends, and a majority of the bottom. In the present embodiment, placing permanent insulation over the top plate 409 would interfere with the harvesting of the product ice.

Refrigeration unit 500 as shown in functional block diagram of FIG. 1, of which no specific drawing is shown, is a commercially available refrigeration system. This system would compose all components of the normal industrial refrigerator, i.e., the motor and compressor, the condenser, together with the remaining smaller components. The evaporator however, will be the evaporator shown in FIG. 6 and the flow of the refrigerant is shown in FIG. 1. It is suggested that the commercially available unit manufactured by Prestcold (North Amercia) Ltd., Montreal, Quebec, Canada, model number TC-300-AM, a 3 ton refrigerator system should be suitable for the preferred embodiment.

Figure 7:
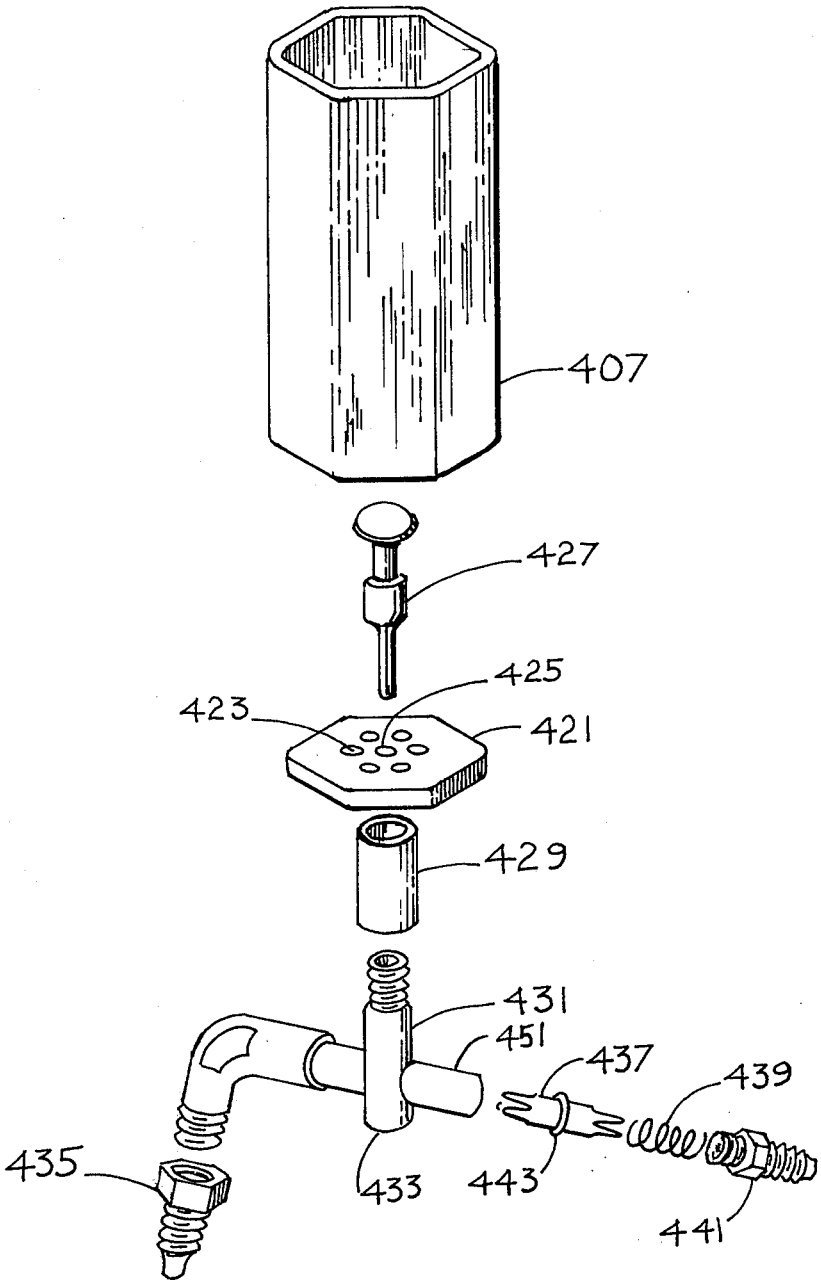
FIG. 7 is an exploded view of the product cell and the bleedback valve.

Referring now to FIG. 7, an exploded view of the product cell construction and bleedback valve is detailed. Beginning at the top of FIG. 7, shown is product cell 407 comprising a hollow elongated sleeve having a hexagonal cross section. Product cell 407 connects with product cell bottom 421 which fits interiorly to product cell 407 and which is secured in place in water tight fashion by being welded exteriorly to the product cell 207 bottom. Through the product cell bottom 421 are a plurality of six water inlet holes 423 and a central hole 425 in which the elongated stem of flapper valve 427 resides. Flapper valve 427, which in the preferred embodiment consists of plyable urethane is basically a valve constructed of a flat disc with stem attached. The circular disc portion o flapper valve 427 covers all holes 423 and, because of its flexible nature, provides a seal against water passing down through holes 423 by the holding pressure of the water on top of the annular disc. The valve is held in place by pulling its stem through central hole 425, there being a tight holding relationship between the central hole and the valve stem.

Continuing on, extension pipe 429 attaches in sealed fashion to the bottom of product cell bottom 421 which, in the preferred embodiment, is accomplished by welding. Since the combination of the product cell bottom 421 and the extension pipe 429 is solid, it is preferred that the stem of flapper valve 427 be sufficiently long and, in its extremity, smaller in size than control hole 425 in order that the flapper valve may be located into its position by extending the smaller portion of the stem through central hole 425 and completely down through extension pipe 429 where it may be held to pull the upper portion of the valve stem into central hole 425. The bottom portion of extension pipe 429 is internally threaded to receive upper pipe section 431 of bleedback valve 433.

Bleedback valve 433 operates to permit the entrance of water from the water distributor 301, through the water distributor product cell water line 309 (FIG. 3), and into the product cell 207. Bleedback valve 433, upon the application of the water through coupling 435, permits the water pressure to push back valve insert 437 against compression spring 439 and bleed coupling 431 until a seal by O-ring 443 is accomplished in pipe 451.

Figure 8:
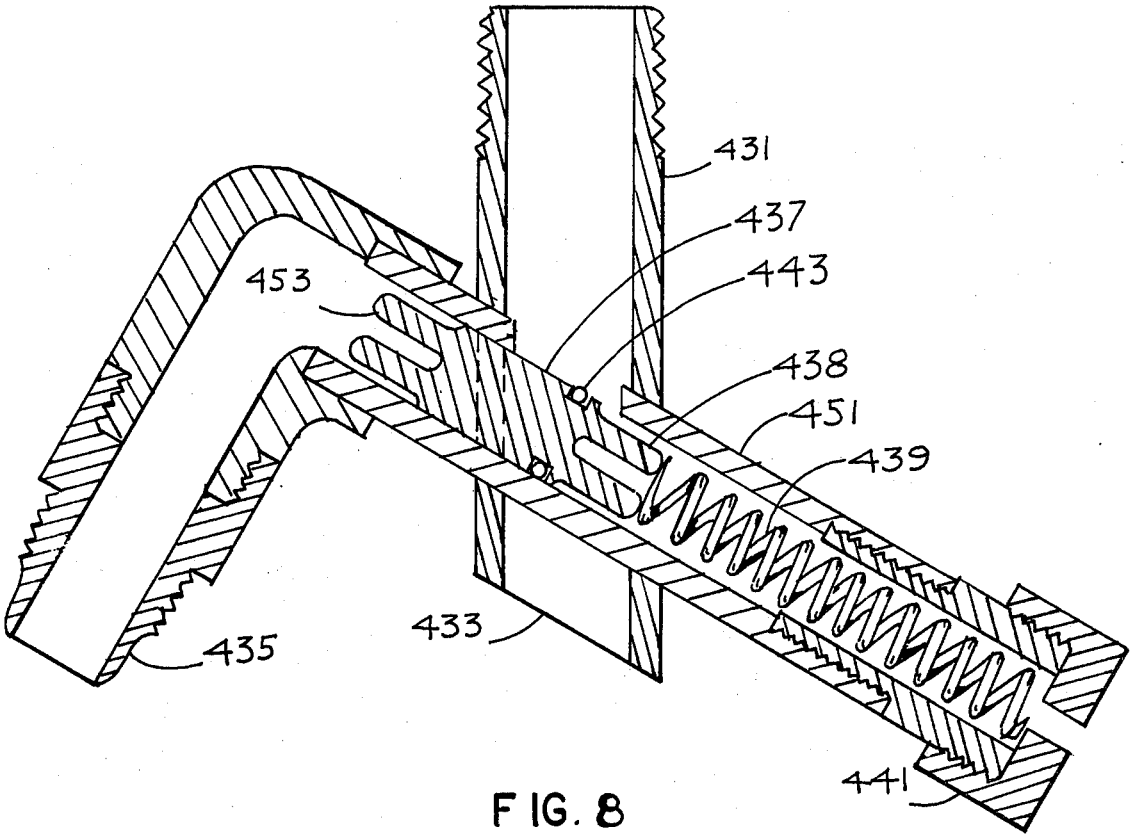
FIG. 8 is a cross sectional view of the bleedback valve.

This may be more easily understood by reference to FIG. 8 which is discussed infra. Thus water pressure forces valve insert 437 back and permits water then to run upwards into upper pipe section 431, to and through extension pipe 429 and into holes 423 of product cell bottom 421. The water then pushes aside and underneath the sides of the disc forming the top of flapper valve 427. The water then forces its way under the frozen ice in product cell 407, pushing the ice block upward and out, or nearly out as desired.

It is noted in the construction of product cell 427 that the interior portion of the cell has a slight outward taper, amounting to about 3/1000 inch over the full length of the 12 to 15 inch height. Additionally, the material utilized in construction of product cells 407 and product cell bottom 421, together with flapper valve 427, must be a type of material to which ice does not readily adhere. In the preferred embodiment, the product cell 407 and product cell bottom 421 are constructed of aluminum alloy 6061, tempered to T-6 condition, polished to #5 micro finish. The flapper valve, as indicated earlier, is constructed of urethane although alternates of neoprene have been utilized. With the slight taper of the interior of product cell 407 as above defined, the water entering the bottom of the cell will be able to push the ice block up as the product cell will be freezing cold and will form a thin coat of ice on its side with the newly incoming water. This water then will not be able to escape around the sides of the ice block and thus achieve a fairly effective seal against water leakage. If however, there is leakage, it will be at such a slow rate in comparison with the incoming water, leakage will be minimal.

When the correct amount of water had been added to the product cell and the distributor indexed to the next cell in the sequence, water to the cell through coupling 435 is shut off, relieving the pressure (there is sufficient clearance between pipe 451 and valve insert 437 to permit a small amount of water, under pressure, to pass in order to relieve the pressure). At this point compression spring 439 urges valve insert 437 forward (upward in FIG. 7) where, around and between 4 protrusions cut in the rear section of valve insert 437, the water which is held in extension pipe 429 is permitted to bleedback around valve 437 and through the center of compression spring 439 and bleed coupling 441 (see also FIG. 8). The purpose for removing the water from the vicinity of the product cell 407 is to prevent the possibility that the water may freeze interiorly to extension pipe 429 and prevent entrance of new water from the water distributor on the next cycle. An enlarged view cross-sectional view of the bleedback valve 433 is shown in FIG. 8 and reference is now made to that figure.

In FIG. 8 the components are shown assembled and in their relaxed state, i.e., water is not being fed by the water distributor to and through coupling 435. In this position, all water which may be interior to bleedback valve 433 has been relieved of its pressure permitting compression spring 439 to urge valve insert 437 to its forward most (upper) position and permitting water to drain down from upper pipe section 431, around protrusions 438 which have been cut into one end of valve insert 437. These protrusions, of which there are four, are constructed by making two cuts, at right angles, into one end of a solid piece of cylindrical shaped plastic material. In the preferred embodiment, the interior portion of these four protrusions have been drilled out to encompass one end of compression spring 439. Proximate the four protrusions 438 is O-ring 443 which, when valve insert 437 is under pressure and pushed to the rear, seal against the sides of pipe 451. When this is accomplished, water will not leak through and around protrusions 438 since they are behind the circle cut in pipe 451 which is also interiorly to upper pipe section 431. Water then entering coupling 435, after pushing valve insert 437 to the rear, then proceeds up into upper pipe section 431. Front protrusions 453, of which there are four in number and are similarly formed as are rear protrusions 438 by making two cuts, at right angles, through the other end of the round cylindrical piece forming valve insert 437, permit the entrance of water into the upper pipe section for product cell filling. The water goes around and between these front protrusions.

As it is obvious, valve insert 437 goes forward to it's normal drain and rest position upon the removal of water pressure and the excess water drains out through the hole central to bleed coupling 441. In the preferred embodiment the bleedback valve is constructed of PVC pipe or other type of plastic pipe. The valve insert 437 may be constructed of teflon or similar material. All parts are appropriately glued with an adhesive or, where shown, screwed together.

Reference is now made to FIG. 9 where the electrical schematic of the system is detailed. Starting at the left portion of FIG. 9, the input power, 110 volt AC runs immediately to the start switch S1 and one side of control relay K1 contact. Thereafter, on the other contact of start switch S1 are connected the main water valve solenoid coil K2 which is contained interiorly to water valve 103 (FIG. 2). Paralleling water valve solenoid coil K2 is index solenoid 385 coil K3 which is interiorly to index assembly box 315 (FIG. 2). Index solenoid coil K3 is in series with meter control switch S2 which is contained interiorly to meter control switch housing 209 (FIG. 2). Connected to the bottom side of control relay K1 coil is the index micro switch or cycle limit switch 381 (FIG. 4), which is in turn series connected with normally closed stop switch S3, the other side of which is directed to the return line on the primary power, 110 volt AC.

In operation and at initial starting, water supplied by the water measuring device, i.e., water meter, to the water distributor is distributed to each of the product cells 407 which fills the cell from the bottom by means of a bleedback valve which has been discussed supra. The measured amount of water fills the product cell 407 from the bottom to a level such that when the water turns to ice, the expansion of the ice causes the surface of the ice to rise just to or near the top of the product cell 407 which will be at or near the top of top plate 409. Each product cell is sequentially filled with the correct amount of water by the water distributor until all product cells are filled. It will be recalled that upon the driven index member 303, a screw head engages an index micro switch which informs the water distributor when all 32 cells have been filled.

Then, the refrigeration system is started and the refrigerant, in liquid form, pumped to the refrigerant gas inlet 417 of the evaporator where it is permitted to expand interiorly and the gas is removed by gas outlet 415. As is well known in the refrigeration cycle, the vaporization of the liquid refrigerant removes the heat from the walls of the product cells 407 and thus freezes the water interior thereto. After all the water in the product cells 407 has frozen, nominally two hours or so, it is time to initiate the ice ejection process of the invention in order that the ice be harvested.

After the ice is frozen, the water distributor begins its cycle again and supplies water to the bottom of the first of the product cells 407. Water in the bottom of the cell, under pressure, disengages the ice from the sides of the cell and pushes the formed block of ice upward. The ice is continued to be pushed by the incoming water until the measured amount of water has entered the bottom portion of the cell. By then, the ice is pushed up to where it clears or nearly clears the top of cell 407 where it resides waiting to be harvested. After the measured amount of water is distributed to one particular cell, the water distributor indexes by one tooth, through the action of the index solenoid, and repeats the procedure for the next product cell in line. These steps are continued until all 32 blocks of ice have been forced out of their product cells by the newly incoming water. After the 32nd and last cell is filled with water, the cycle limit switch, also termed the index micro switch, shuts off the system and the refrigeration cycle starts anew. The ice, which will all be setting off the top of the product cells is then harvested. In the preferred embodiment, the complete cycle of filling all cells with new water is completed in less than 4 minutes but this cycle rate is effected by the size of each cell, the pressure which the water is supplied to the system, and the other obvious factors which tend to effect the filling rate of each cell. In the preferred embodiment, a 12 pound block of ice is obtained.

The operation of the electrical schematic in the system is as follows. The switches and relays are shown in FIG. 9 in their normal non-operational or steady state. Assuming that the system is going to be initially started, start switch S1 is depressed which momentarily contacts its contact points. First, control relay K1 coil energizes and closes the normally open contact of control relay K1, thereby circuit being made through K1 relay coil, cycle limit switch 381 in its normal closed position, and stop switch S3 which also is normally closed. Water valve 103 solenoid coil relay K2 which was also energized, opens the water line permitting water to flow through the water meter 203 (FIG. 2). The relationship of momentary contact start switch S1 and control relay K1 is such that control relay K1 is wired as a locking relay which, through the contacts of control relay K1, permit the continuing powering of the remainder of the electrical components in the circuit. After initial depression of start switch S1, it returns to its normally open state and power is continually supplied the system through the contacts of control relay K1.

The system will remain in this position while water meter 203 monitors the water flowing therethrough and after the required amount of water has flown, meter control switch S2 is momentarily closed. With meter control switch S2 closed, index solenoid 385 coil K3 is energized which indexes driven index member 303 (FIG. 3) around by one tooth. Since meter control switch S2 is a momentary type switch, it being of the type that a cog upon a wheel internal to the water meter trips and then moves on. Index solenoid 385 (FIG. 4) then retracts to its initial un-energized position. The system continues supplying water to distributor 300 until water meter 203 indicates that a specified amount of water has passed again at which time the momentary closure of water meter control switch S2 is initiated. This results in responding index solenoid coil K3 being again energized and driven index member 303 again moved one index tooth.

The system continues this operation until the screw head 383 tripping mechanism moves completely around and trips index micro switch 381, the cycle limit switch, at which time the current passing through control relay K1 coil is interrupted and the relay contacts are permitted to return to the normally open position. This shuts down the whole system, de-energizing the water valve solenoid coil K2 contained interiorly to water valve 103 and interrupts water to water meter 203 (FIG. 2).

The screw head 383 which trips the cycle limit switch 381 is positioned such as to interrupt control relay K1 towards the end of the index solenoid travel in order that the driven index member 303, in combination with the detent ball 329 and dimple 333 (FIG. 3) carry driven index member 303 into the next index position, by which time the cycle limit switch 381 has completely riden over the screw head 383 (FIG. 4). The system then is in position waiting for the start signal for the next cycle, it having cycled through all of the product cells and then shut down by the trip action of the screw head 383 upon the cycle limit switch 381. Stop switch S3, a momentary type switch, is used to stop the system at any time. It functions like cycle limit switch 381, which upon its depression, momentarily interrupts the control relay K1 feeding power to the system and then switch S3 returns to its normally closed position.

In the construction of the electrical components which make up the system, the use of components commercially available have been done, the start-stop switch being a General Electric switch, part number CR2940-NA102A; the cycle limit switch 381 being a Unimax, 2HBHA-5 normally closed switch; the water valve solenoid actuated being a Dayton, stock number 6Xo81, solenoid normally closed valve; the index solenoid being a Dormeyer Super T, 3000-M-1 interrupted solenoid; water meter control switch S2 being a Unimax 2HBHA-5 normally open switch; and control relay K1, a standard 110 volt single pole normally open relay. The water meter is a Kent, PSM-190.

Figure 10:
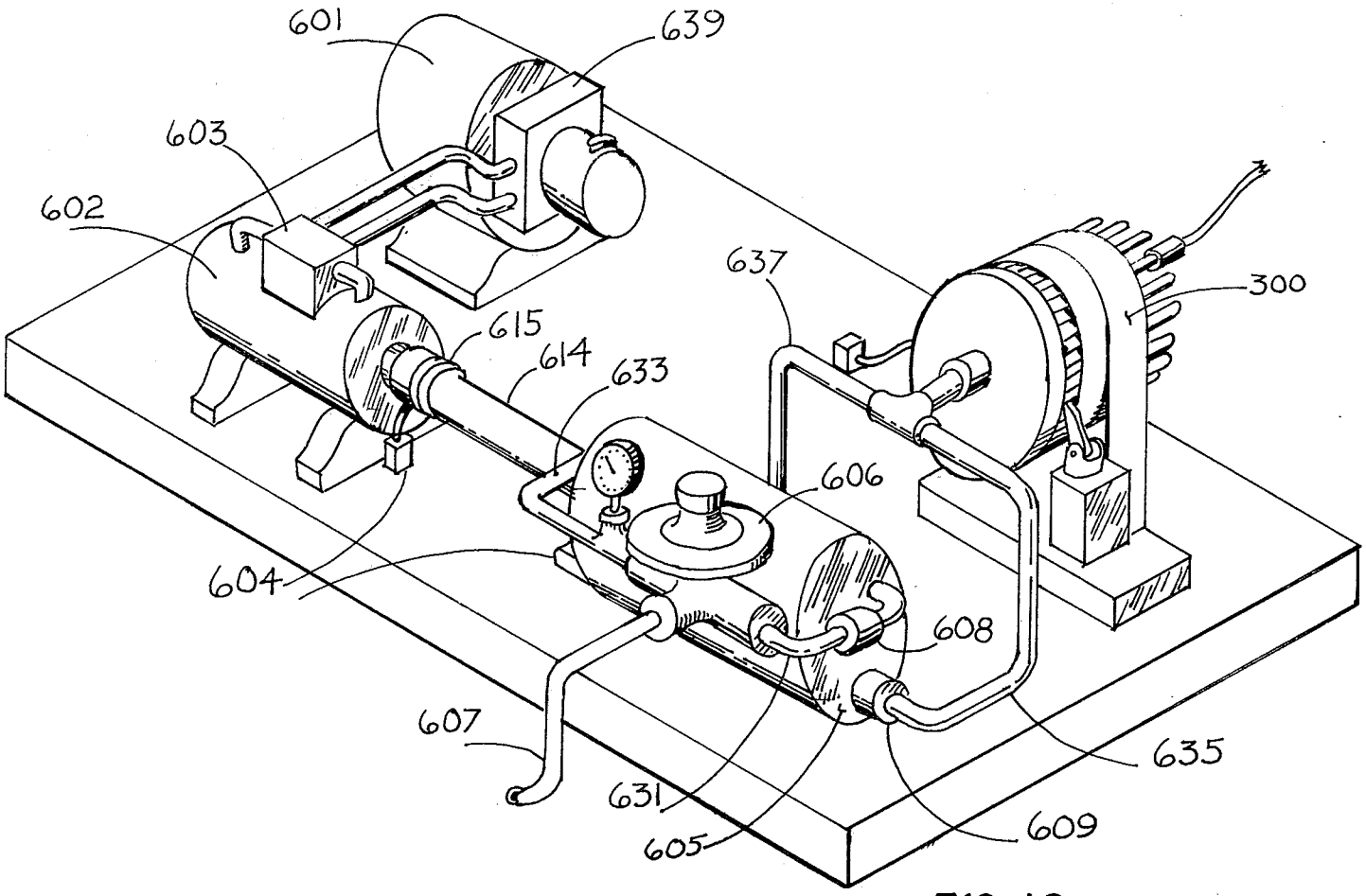
FIG. 10 is a perspective view of an alternate embodiment of the water measuring device and water distributor.

While the preferred embodiment has been shown and described in this specification, an alternate embodiment of the invention has been devised and is shown in FIG. 10. Referring specifically to FIG. 10, the alternate embodiment shown primarily provides a method to substitute a double acting cylinder-piston arrangement for water meter 203. More specifically, the water is introduced into the double acting piston cylinder 605 through water line 607. Interposed the entrance of water line 607 is water pressure regulator 606 which directs the water at a constant pressure along water outlets 631 and 633 to opposite ends of cylinder 605 where, one way check valves 608 (located at both ends) permit passage of the water into the cylinder only. The piston interior (not shown) to cylinder 605 is movable in either direction. For movement from left to right, water is forced out of the cylinder through a preset resistive pressure valve 609, the pressure being overcome and water injected into water line 635 which connects with the entrance to the water distributor 300 which has already been shown and described supra. Similarly, from the other side of cylinder 605, a similar preset resistive pressure valve connects between the end of cylinder 605 and water line 637. Water line 637 additionally connects to the central water inlet of water distributor 300.

Connecting the piston internal to cylinder 605 is piston shaft 614 which is driven in a reciprocating motion by means of hydraulic double acting piston and cylinder arrangement 602. A solenoid powered fluid valve switch system connecting with the hydraulic piston cylinder arrangement 602 is shown atop the hydraulic cylinder 602 and is numbered 603. Motor 601 then powers hydraulic pump 639. In order to limit the travel of piston shaft 614, a ring 615 is fit about piston shaft 14. Ring 615 engages microswitches 604 which are at opposite ends of shaft travel and which are electrically connected with the solenoid actuated switch 603. The hydraulic piston cylinder system travels to one, engages the microswitch, reverses direction and travels to the other end and repeats the process.

In operation, the system cycles measured amounts of water to water distributor 300 by means of precise travel of the piston internally to cylinder 605, which travel is determined by placement of the two micro switches 604. The system will operate automatically until stopped by the cycle limit switch. The electrical schematic is the same with the exception that the main water valve solenoid is replaced with the motor 601.

While a preferred embodiment of the subject invention together with one alternate embodiment of the invention have been shown and described, it is appreciated that there is no intent to limit the invention except in accordance with the appended claims.

I claim:

1. A method for the continuously refrigerated, automatically ejected making of block ice comprising the steps of:

receiving water from a water supply, said step including the steps of measuring the volume of water received, and generating a signal when the specific volume of water has been measured;

selectively distributing the water to one of a plurality of ice product cells, said step including the steps of directing the water to the ice product cell so selected through water lines, filling the ice product cell with water, receiving the signal generated when the specific volume of water has been measured, holding the water in the ice product cell, draining away water in the water line proximate the ice product cell, and distributing the water to a new ice product cell when the signal indicating a specific volume of water which had been measured is received;

ejecting a previously formed ice block in the ice product cell so selected; and freezing the water in the ice product cell to form a new block of ice.

2. The method for making block ice as defined in claim 1 wherein the step of ejecting a previously formed ice block in the ice product cell comprises the step of:

filling the ice product cell with water.

3. The method for making block ice as defined in claim 2 wherein the step of distributing the water to the ice product cell additionally comprises the step of:

generating a signal when all the ice product cells have had prior ice ejected and have filled with water.

4. The method for making block ice as defined in claim 3 wherein the step of receiving water from the water supply additionally comprises the step of:

shuting off the water from the water supply when the signal is generated that indicates that all product cells have ejected the prior formed ice and have been filled with water.

* * * * *